US009580777B1

(12) United States Patent
Radon et al.

(10) Patent No.: US 9,580,777 B1
(45) Date of Patent: Feb. 28, 2017

(54) HYPEREUTECTIC WHITE IRON ALLOYS COMPRISING CHROMIUM, BORON AND NITROGEN AND ARTICLES MADE THEREFROM

(71) Applicants: Roman Radon, Belleview, FL (US); Raphael Radon, Alexandria, VA (US)

(72) Inventors: Roman Radon, Belleview, FL (US); Raphael Radon, Alexandria, VA (US)

( * ) Notice: Subject to any disclaimer, the term of this patent is extended or adjusted under 35 U.S.C. 154(b) by 0 days.

(21) Appl. No.: 15/018,597

(22) Filed: Feb. 8, 2016

(51) Int. Cl.
*C22C 37/06* (2006.01)
*C22C 37/08* (2006.01)
*C22C 37/10* (2006.01)

(52) U.S. Cl.
CPC ..... *C22C 37/10* (2013.01); *C22C 37/06* (2013.01)

(58) Field of Classification Search
CPC ..... C22C 33/08
See application file for complete search history.

(56) References Cited

U.S. PATENT DOCUMENTS

| | | | | |
|---|---|---|---|---|
| 2,353,688 | A | 7/1944 | Burgess | |
| 3,834,950 | A | 9/1974 | Feltz | |
| 5,252,149 | A | 10/1993 | Dolman | |
| 5,514,065 | A * | 5/1996 | Noda | B21B 27/00 29/895.32 |
| 5,803,152 | A | 9/1998 | Dolman et al. | |
| 5,936,169 | A | 8/1999 | Pinnow et al. | |
| 6,761,777 | B1 | 7/2004 | Radon | |
| 8,083,869 | B2 * | 12/2011 | Takayama | C21D 5/00 148/321 |
| 8,187,529 | B2 * | 5/2012 | Powell | C22C 37/10 148/324 |
| 9,284,631 | B2 * | 3/2016 | Radon | C22C 37/10 |
| 2012/0160363 | A1 | 6/2012 | Jin et al. | |
| 2013/0084462 | A1 | 4/2013 | Theisen et al. | |
| 2014/0377587 | A1 * | 12/2014 | Oda | B21B 27/032 428/682 |
| 2015/0329944 | A1 | 11/2015 | Radon et al. | |
| 2016/0193637 | A1 * | 7/2016 | Oda | B22D 13/026 72/252.5 |

FOREIGN PATENT DOCUMENTS

| | | | | |
|---|---|---|---|---|
| CN | 101497966 | A | 8/2009 | |
| CN | 102251185 | A | 11/2011 | |
| GB | 2153846 | | 8/1985 | |
| JP | WO 2015045720 | A1 * | 4/2015 | B22D 13/026 |
| WO | 8404760 | A1 | 12/1984 | |

OTHER PUBLICATIONS

"Glossary of Metallurgical and Metalworking Terms," Metals Handbook, ASM International, 2002, term(s): hypereutectic alloy, white iron.*

Heat Treating of High-Alloy White Cast Irons, Heat Treating of Irons and Steels, vol. 4D, ASM Handbook, ASM International, 2014, pp. 527-535 (print), 27 pages (consolidated) online.*

* cited by examiner

*Primary Examiner* — Scott Kastler
*Assistant Examiner* — Vanessa Luk
(74) *Attorney, Agent, or Firm* — Abel Law Group, LLP

(57) ABSTRACT

Disclosed are a hypereutectic white iron alloy and articles such as pump components made therefrom. Besides iron and unavoidable impurities the alloy comprises, in weight percent based on the total weight of the alloy, from 3 to 6 C, from 0.01 to 1.2 N, from 0.1 to 4 B, from 3 to 48 Cr, from 0.1 to 7.5 Ni and from 0.1 to 4 Si and, optionally, one or more of Mn, Co, Cu, Mo, W, V, Mg, Ca, rare earth elements, Nb, Ta, Ti, Zr, Hf, Al.

19 Claims, 3 Drawing Sheets

HYPEREUTECTIC WHITE IRON ALLOYS COMPRISING CHROMIUM, BORON AND NITROGEN AND ARTICLES MADE THEREFROM

BACKGROUND OF THE INVENTION

1. Field of the Invention

The present invention relates to a hypereutectic white iron alloy that comprises chromium, boron and nitrogen, as well as to articles such as pump components made therefrom (e.g., by sand casting).

2. Discussion of Background Information

High chromium white iron alloys find use as abrasion resistant materials for the manufacture of, for example, casings of industrial pumps, in particular pumps which come into contact with abrasive slurries of minerals. This alloy material has exceptional wear resistance and good toughness with its hypoeutectic and eutectic compositions. For example, high chromium white iron in accordance with the ASTM A532 Class III Type A contains from 23% to 30 wt. % of chromium and about 3.0% to 3.3 wt. % of carbon. However, in severely abrasive applications the wear resistance of these high chromium white iron alloys is not satisfactory due to a lack of a sufficient "Carbide Volume Fraction" (CVF). It is well known that increasing the content of both Cr and C can considerably improve the wear resistance of high chromium white iron alloys under severely abrasive conditions. For example, hypereutectic Fe—Cr—C alloys for hardfacing typically contain 4.5% C and 24% Cr. The amount of carbides and in particular, the CVF can be estimated from the following experimentally developed equation: CVF=12.33×% C+0.55×(% Cr+M)−15.2% (M representing one or more carbide forming elements in addition to chromium, if any). For the above hardfacing alloy, CVF=(12.33×4.5%)+(0.55×24%)−15.2%=53.5%.

Hardfacing has the benefit of making an article wear resistant by cladding, i.e., by depositing a layer of an alloy of wear resistant composition thereon. However, hardfacing methods have disadvantages, including a limited thickness of the cladding, distortion of the article to be cladded, and high costs of labor, cladding material and equipment. Moreover, the cladding usually is susceptible to developing defects such as spalling and cracking due to thermal stresses and contraction, and it shows constraints with respect to thermal hardening.

Further, making (slurry) pump components such as pump casings by common foundry methods from hypereutectic high chromium white iron alloys is virtually impossible due to high scrap and rejection rates. Pump casings are large and heavy and are not uniform in thickness. For example, cross-sections in some areas of a pump casing may be up to 10 inch and the wall thickness in at least some parts thereof may be 1 inch or even higher. In view thereof, it is virtually impossible for a casting to cool uniformly in a sand mold, which results in stress induced cracking during cooling.

In particular, during solidification in a sand mold, hypereutectic high chromium cast iron forms a primary phase by nucleation and growth processes. Large primary chromium carbides, up to several hundreds microns in length, crystallize in the thick sections of the casting where the cooling is slower than in the remainder of the casting. These large primary carbides lower the fracture toughness of a casting, wherefore the casting usually cracks during the manufacturing process or later during application in the work field.

For the foregoing reasons, hypereutectic high chromium white cast iron alloys have in the past not been suitable for the sand casting of large parts and there have been various attempts to address this problem.

The background section of WO 84/04760, the entire disclosure of which is incorporated by reference herein, which primarily relates to high chromium white cast iron alloys of both hypoeutectic and hypereutectic compositions, describes the many failed attempts to develop satisfactory hypereutectic white iron alloys for castings, which combine wear resistance with fracture toughness. This document also describes various attempts to develop hypoeutectic compositions, and draws on attempts in the art to develop suitable hardfacing alloys as providing possible solutions to the wear resistance vs fracture toughness dilemma. However, according to WO 84/04760 the cracking problem of cast compositions is in fact predominantly solved by forming them as cast composites—namely by creating a composite component comprising the preferred alloy metallurgically bonded to a substrate, thus assisting with avoiding the likelihood of cracking upon cooling of the cast alloy. WO 84/04760 seeks to overcome the disadvantages of low fracture toughness and cracking with hypereutectic castings having greater than 4.0 wt. % carbon by ensuring the formation in a composite casting of primary $M_7C_3$ carbides with mean cross-sectional dimensions no greater than 75 μm, and suggests a variety of mechanisms for doing so. Thus, WO 84/04760 aims to overcome the problem by forming composite components and limiting the size of the primary $M_7C_3$ carbides in the alloy itself.

U.S. Pat. No. 5,803,152, the entire disclosure of which is incorporated by reference herein, also seeks to refine the microstructure of, in particular, thick section hypereutectic white iron castings, in order to maximize the nucleation of primary carbides, thereby enabling an increase not only in fracture toughness but also in wear resistance. This refinement is achieved by introducing a particulate material into a stream of molten metal as the metal is being poured for a casting operation. The particulate material is to extract heat from, and to undercool, the molten metal into the primary phase solidification range between the liquidus and solidus temperatures. This method has the limitation of a difficult to achieve even distribution of the additive, a particulate material, into a stream of molten metal as the metal is being poured for a casting operation. The particulate material consists mainly of chromium carbides which contain about 10% C and 90% Cr and is added to the stream of molten metal in amounts of up to 10%. This addition of carbides increases the carbon and chromium concentrations in the already hypereutectic base alloy iron and causes a shift and extension of the interval between liquidus temperature and solidus temperature Substituting nitrogen for carbon is known for the production of High Strength Low Alloy Steels (HSLAS). The HSLAS comprise about 0.15% C, 0.03% N and 0.15% V. In this case it was shown that for every added 0.01% of C the strength increases by 5.5 MPa after thermo-mechanical processing, while for every added 0.001% of N the corresponding increase is 6 MPa. It was found that vanadium and nitrogen first form pure VN nuclei, which subsequently grow at the expense of solute nitrogen. When nitrogen is exhausted, the solute carbon precipitates and progressively transforms the nitrides into carbonitrides $V(C_yN_{1-y})$ instead of into precipitates of VC. These carbonitrides are of submicron size and crystallize in the face-centered cubic NaCl type crystal structure.

Another advantage of the substitution of nitrogen for carbon in iron alloys is described in U.S. Pat. No. 6,761,777, the entire disclosure of which is incorporated by reference herein. This patent discloses alloys containing from 0.01% to 0.7% of N and showing improved mechanical properties, in particular corrosion and wear resistance, due to nitrogen giving rise to the formation of carbonitride precipitates and solid solution strengthening.

Further, titanium nitride is produced intentionally within some steels by addition of titanium to an alloy. TiN forms at very high temperatures and nucleates directly from the melt in secondary steelmaking. Titanium nitride has the lowest solubility product of any metal nitride or carbide in austenite, a useful attribute in microalloyed steel formulas.

US 2015/0329944 A1, the entire disclosure of which is expressly incorporated by reference herein, discloses a hypereutectic white iron alloy and articles such as pump components made therefrom. Besides iron and unavoidable impurities the alloy comprises, in weight percent based on the total weight of the alloy, from 2.5 to 6.5 C, from 0.04 to 1.2 N and from 18 to 58 Cr and, optionally, one or more of Mn, Ni, Co, Cu, Mo, W, V, Mg, Ca, Si, rare earth elements, Nb, Ta, Ti, Zr, Hf, Al, B.

All of the alloys mentioned above have in common that they require a hardening treatment such as a heat treatment to increase the hardness of articles cast therefrom to a level which is suitable for applications such as pump components. It would thus be advantageous to have available hypereutectic white iron alloys which already in the as cast state, i.e., without hardening treatment after casting, exhibit a hardness which is sufficient for corresponding applications.

SUMMARY OF THE INVENTION

The present invention provides a hypereutectic chromium white iron alloy. The alloy comprises, in weight percent based on the total weight of the alloy, from 3 to 6 carbon, from 0.01 to 1.2 nitrogen, from 0.1 to 4 boron, from 3 to 48 chromium, from 0.1 to 7.5 Ni, and from 0.1 to 4 Si. The alloy may optionally comprise one or more additional elements, especially manganese (up to 8), cobalt (up to 5), copper (up to 5), molybdenum (up to 5), tungsten (up to 6), vanadium (up to 12), niobium (up to 6), titanium (up to 5), zirconium (up to 2), magnesium and/or calcium (total up to 0.2), one or more rare earth elements, i.e., one or more of Sc, Y, La, Ce, Pr, Nd, Pm, Sm, Eu, Gd, Tb, Dy, Ho, Er, Tm, Yb, Lu (total up to 3), and one or more of tantalum, hafnium, aluminum, (total up to 3). The remainder of the alloy usually is constituted by iron and unavoidable (incidential) impurities.

In some embodiments, the above alloy may exhibit a carbide-boride-nitride volume fraction (CBNVF) of at least 50, e.g., at least 55, at least 60, or at least 65, calculated according to the following equation.

$$CBNVF=C_E\times 12.33+(\%\ Cr+\%\ M)\times 0.55-15.2,$$

with M representing a total percentage of V, Mo, Nb, and Ti and $C_E$(carbon equivalent)=% C+% N+(f×% B), where f=1.2 for B concentrations from 0.1% to 0.49%

1.48 for B concentrations from 0.5% to 0.99%

2.2 for B concentrations from 1.0% to 1.8%

2.6 for B concentrations from 1.81% to 2.5%

2.7 for B concentrations from 2.51% to 3.0%

2.8 for B concentrations from 3.01% to 4%.

Further, in some embodiments the above alloy may exhibit a Brinell hardness (HB), as measured with a 10 mm tungsten ball and a load of 3000 kgf, of at least 700, e.g., at least 710, at least 720, at least 730, at least 740, at least 750, at least 760, at least 770, at least 780, at least 790, or at least 800 in the as cast state (i.e., as cast into a sand mold without any subsequent hardening treatment such as a heat treatment).

In some embodiments (hereafter referred to as "embodiments (i)") the alloy of the present invention as set forth above may comprise, in weight percent based on the total weight of the alloy, from 3 to 4.8 carbon, from 0.01 to 0.1 nitrogen, from 0.5 to 4 boron, from 3 to 11 chromium (e.g., at least 7 chromium), from 4 to 7.5 Ni, from 1.6 to 2.8 Si, from 0.1 to 3 Mn, and from 0.1 to 2 Al. The alloy of embodiment (i) may optionally comprise one or more additional elements, especially cobalt (up to 5, preferably absent), copper (up to 5, preferably absent), molybdenum (up to 1), tungsten (up to 2), vanadium (up to 2), niobium (up to 2), titanium (up to 3), zirconium (up to 2), magnesium and/or calcium (total up to 0.2), one or more rare earth elements, i.e., one or more of Sc, Y, La, Ce, Pr, Nd, Pm, Sm, Eu, Gd, Tb, Dy, Ho, Er, Tm, Yb, Lu (total up to 3), and one or both of tantalum and hafnium (total including aluminum up to 3). The remainder of an alloy according to embodiment (i) is constituted by iron and unavoidable (incidential) impurities. The alloys of embodiment (i) may further exhibit a CBNVF value of at least 55, e.g., at least 60, at least 65, at least 70, or at least 75 and/or a Brinell hardness in the as cast state of at least 700, e.g., at least 710, at least 720, at least 730, at least 740, at least 750, at least 760, at least 770, at least 780, at least 790, or at least 800.

In some embodiments (hereafter referred to as "embodiments (ii)") the alloy of the present invention as set forth above may comprise, in weight percent based on the total weight of the alloy, from 3.5 to 4.5 carbon, from 0.01 to 0.2 nitrogen, from 0.4 to 3.5 boron, from 12 to 23 chromium (e.g., at least 13 chromium), from 0.1 to 4 Ni (e.g., at least 1.5 Ni), from 1.6 to 2.8 Si, from 0.1 to 5 Mn (e.g., at least 2 Mn), and from 0.01 to 1.5 Al. The alloy may optionally comprise one or more additional elements, especially cobalt (up to 5, preferably absent), copper (up to 5, preferably absent), molybdenum (up to 3), tungsten (up to 2), vanadium (up to 5), niobium (up to 2), titanium (up to 3), zirconium (up to 2), magnesium and/or calcium (total up to 0.2), one or more rare earth elements, i.e., one or more of Sc, Y, La, Ce, Pr, Nd, Pm, Sm, Eu, Gd, Tb, Dy, Ho, Er, Tm, Yb, Lu (total up to 3), and one or both of tantalum and hafnium (total including aluminum up to 3). The remainder of an alloy according to embodiment (ii) is constituted by iron and unavoidable (incidential) impurities. The alloys of embodiment (ii) may further exhibit a CBNVF value of at least 55, e.g., at least 60, at least 65, at least 70, or at least 75 and/or a Brinell hardness in the as cast state of at least 700, e.g., at least 710, at least 720, at least 730, at least 740, at least 750, at least 760, at least 770, at least 780, at least 790, or at least 800.

In some embodiments (hereafter referred to as "embodiments (iii)") the alloy of the present invention as set forth above may comprise, in weight percent based on the total weight of the alloy, from 3.5 to 4.5 carbon, from 0.01 to 0.3 nitrogen, from 0.6 to 3.5 boron, from 24 to 30 chromium, from 0.1 to 4 Ni (e.g., at least 1.5 Ni), from 1.6 to 2.8 Si, from 0.1 to 5 Mn (e.g., at least 3 Mn), and from 0.01 to 1.5 Al. The alloy may optionally comprise one or more additional elements, especially cobalt (up to 5, preferably absent), copper (up to 5, preferably absent), molybdenum (up to 3), tungsten (up to 2), vanadium (up to 5), niobium (up to 2), titanium (up to 3), zirconium (up to 2), magnesium and/or calcium (total up to 0.2), one or more rare earth elements, i.e., one or more of Sc, Y, La, Ce, Pr, Nd, Pm, Sm, Eu, Gd, Tb, Dy, Ho, Er, Tm, Yb, Lu (total up to 3), and one or both of tantalum and hafnium (total including aluminum up to 3). The remainder of an alloy according to embodiment (iii) is constituted by iron and unavoidable (incidential) impurities. The alloys of embodiment (iii) may further exhibit a CBNVF value of at least 55, e.g., at least 60, at least 65, at least 70, or at least 75 and/or a Brinell hardness in the as cast state of at least 700, e.g., at least 710, at least 720, at least 730, at least 740, at least 750, at least 760, at least 770, at least 780, at least 790, or at least 800.

In some embodiments (hereafter referred to as "embodiments (iv)") the alloy of the present invention as set forth above may comprise, in weight percent based on the total weight of the alloy, from 3.5 to 6 carbon, from 0.01 to 1.2 nitrogen, from 0.6 to 3.5 boron, from 31 to 48 chromium, from 0.1 to 3.5 Ni, from 1.6 to 3.5 Si, from 0.1 to 8 Mn (e.g., at least 4 Mn), and from 0.01 to 1.5 Al. The alloy may optionally comprise one or more additional elements, especially cobalt (up to 5, preferably absent), copper (up to 5, preferably absent), molybdenum (up to 3), tungsten (up to 2), vanadium (up to 5), niobium (up to 2), titanium (up to 3), zirconium (up to 2), magnesium and/or calcium (total up to 0.2), one or more rare earth elements, i.e., one or more of Sc, Y, La, Ce, Pr, Nd, Pm, Sm, Eu, Gd, Tb, Dy, Ho, Er, Tm, Yb, Lu (total up to 3), and one or both of tantalum and hafnium (total including aluminum up to 3). The remainder of an alloy according to embodiment (iv) is constituted by iron and unavoidable (incidential) impurities. The alloys of embodiment (iv) may further exhibit a CBNVF value of at least 55, e.g., at least 60, at least 65, at least 70, or at least 75 and/or a Brinell hardness in the as cast state of at least 700, e.g., at least 710, at least 720, at least 730, at least 740, at least 750, at least 760, at least 770, at least 780, at least 790, or at least 800.

The present invention also provides an article which comprises or consists (or consists essentially) of the alloy of the present invention as set forth above (including the various embodments thereof). If the article merely comprises the alloy of the present invention, it may, for example, be present in the form of a cladding (e.g., for hardfacing). The thickness of the cladding can vary over a wide range and can, for example, be in the range of from 1 mm to 5 cm or even higher. The same applies to the thickness of a section of an article that is made from the alloy of the present invention.

In some embodiments, the article of the present invention may have been cast from the alloy and/or may be a component (e.g., a casing) of a pump (e.g., of a slurry pump).

The present invention also provides a method of manufacturing the article of the present invention as set forth above. The method comprises casting the alloy in a sand mold or subjecting it to chill casting (e.g., in a copper mold).

BRIEF DESCRIPTION OF THE DRAWINGS

The present invention is further described in the detailed description which follows, in reference to the drawings wherein.

DETAILED DESCRIPTION OF THE PRESENT INVENTION

Figure 1:
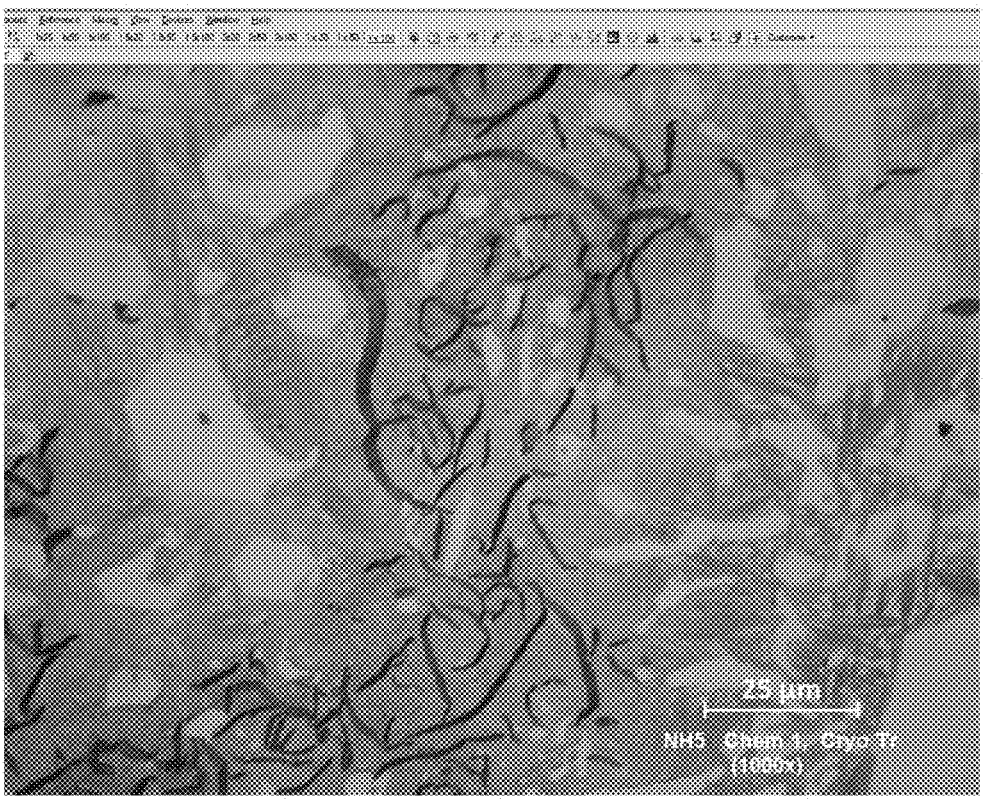
FIG. 1 shows the microstructure of a sample made from Alloy No. 1 set forth below.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

As used herein, the singular forms "a," "an," and "the" include the plural reference unless the context clearly dictates otherwise. For example, reference to "an alloy" would also mean that combinations of two or more alloys can be present unless specifically excluded.

Except where otherwise indicated, all numbers expressing quantities of ingredients, reaction conditions, etc. used in the instant specification and appended claims are to be understood as being modified in all instances by the term "about." Accordingly, unless indicated to the contrary, the numerical parameters set forth in the specification and claims are approximations that may vary depending upon the desired properties sought to be obtained by the present invention. At the very least, each numerical parameter should be construed in light of the number of significant digits and ordinary rounding conventions.

Additionally, the disclosure of numerical ranges within this specification is considered to be a disclosure of all numerical values and ranges within that range. For example, if a range is from 1 to 50, it is deemed to include, for example, 1, 7, 34, 46.1, 23.7, or any other value or range within the range.

The various embodiments disclosed herein can be used separately and in various combinations unless specifically stated to the contrary.

The present invention provides a hypereutectic high chromium white iron alloy wherein a considerable portion of the carbon is replaced by nitrogen and boron. This substitution of carbon by nitrogen and in particular, boron beneficially causes a narrowing of the hypereutectic solidification temperature area and brings the solidification temperature closer to, or even renders it equal to, eutectic solidification temperatures, thereby narrowing the alloy liquidus temperature—solidus temperature interval. This causes a refinement of primary and eutectic phases of the cast high chromium alloy. The addition of boron and nitrogen further results in a considerable increase of the hardness of the alloy in the as cast state (i.e., without any subsequent hardening treatment).

Without wishing to be bound by any theory, it is believed that the substitution of carbon by boron and nitrogen causes a change of the morphology of the carbides $M_7C_3$ (with M=Cr, V, Ti, Nb, Al, Mo, W, etc.) into carbon-boron nitrides $M_7(C,B,N)_3$, $M_3(C,B,N)$ and $M_{23}(C,B,N)_6$. These carbon-boron nitrides optimize the refinement in terms of size and homogeneous distribution in the cast microstructure and substantially increase the carbide-boride-nitride volume fraction (CBNVF).

In addition to iron, the alloy of the present invention comprises six required components, i.e., C, B, N, Cr, Si and Ni. The weight percentage of Cr in the alloy is at least 3%, but not higher than 48%. in the embodiments (i) set forth above the weight percentage of Cr usually is at least 3%, e.g., at least 4%, at least 5%, at least 6%, at least 7%, at least 7.5%, or at least 8%, but not higher than 11%, e.g., not higher than 10.5%, or not higher than 10%. In the embodiments (ii) set forth above the weight percentage of Cr usually is at least 12%, e.g., at least 13%, at least 14%, or at least 15%, but not higher than 23%, e.g., not higher than 22%, not higher than 21%, not higher than 20%, not higher than 19%, not higher than 18%, or not higher than 17%. In the embodiments (iii) set forth above the weight percentage of Cr usually is at least 24%, e.g., at least 25%, at least 26%, or at least 27%, but not higher than 30%, e.g., not higher than 29.5%, or not higher than 29%. In the embodiments (iv) set forth above the weight percentage of Cr usually is at least 31%, e.g., at least 32%, at least 33%, at least 34%, at least 35%, at least 36%, or at least 37%, but not higher than 48%, e.g., not higher than 46%, not higher than 44%, not higher than 42%, not higher than 41%, or not higher than 40%.

The weight percentage of C in the alloy of the present invention is at least 3%, e.g., at least 3.1%, at least 3.2%, at least 3.3%, at least 3.4%, at least 3.5%, at least 3.6%, at least 3.7%, or at least 3.8%, but not higher than 6%, e.g., not higher than 5.5%, not higher than 5%, not higher than 4.8%, or not higher than 4.5%. In the embodiments (i) set forth above, the weight percentage of C usually is at least 3%, e.g., at least 3.1%, at least 3.2%, at least 3.3%, at least 3.4%, at least 3.5%, at least 3.6%, at least 3.7%, or at least 3.8%, but not higher than 4.8%, e.g., not higher than 4.7%, not higher than 4.6%, not higher than 4.5%, not higher than 4.4%, not higher than 4.3%, not higher than 4.2%, or not higher than 4.1%. In the embodiments (ii) set forth above the weight percentage of C usually is at least 3.5%, e.g., at least 3.6%, at least 3.7%, or at least 3.8%, but not higher than 4.5%, e.g., not higher than 4.4%, not higher than 4.3%, not higher than 4.2%, or not higher than 4.1%. In the embodiments (iii) set forth above the weight percentage of C usually is at least 3.5%, e.g., at least 3.6%, at least 3.7%, or at least 3.8%, but not higher than 4.5%, e.g., not higher than 4.4%, not higher than 4.3%, not higher than 4.2%, or not higher than 4.1%. In the embodiments (iv) set forth above the weight percentage of C usually is at least 3.5%, e.g., at least 3.6%, at least 3.7%, at least 3.8%, at least 3.9%, or at least 4%, but not higher than 6%, e.g., e.g., not higher than 5.5%, not higher than 5%, not higher than 4.8%, or not higher than 4.6%.

The weight percentage of N in the alloy of the present invention is at least 0.01%, e.g., at least 0.02%, at least 0.03%, at least 0.04%, at least 0.05%, at least 0.06%, at least 0.07%, at least 0.08%, at least 0.09%, at least 0.1%, at least 0.15%, at least 0.2%, at least 0.25%, at least 0.3%, at least 0.35%, or at least 0.4%, but not higher than 1.2%, e.g., not higher than 1.1%, not higher than 1%, not higher than 0.9%, or not higher than 0.8%. In the embodiments (i) set forth above the weight percentage of N usually is at least 0.01%, e.g., at least 0.015%, at least 0.02%, or at least 0.03%, but not higher than 0.1%, e.g., not higher than 0.09%, not higher than 0.08%, or not higher than 0.07%. In the embodiments (ii) set forth above the weight percentage of N usually is at least 0.01%, e.g., at least 0.015%, at least 0.02%, at least 0.03%, at least 0.04%, or at least 0.05%, but not higher than 0.2%, e.g., not higher than 0.18%, not higher than 0.15%, or not higher than 0.12%, or not higher than 0.1%. In the embodiments (iii) set forth above the weight percentage of N usually is at least 0.01%, e.g., at least 0.015%, at least 0.02%, at least 0.03%, at least 0.04%, at least 0.05%, at least 0.06%, at least 0.08%, or at least 0.1%, but not higher than 0.3%, e.g., not higher than 0.25%, not higher than 0.2%, not higher than 0.18%, or not higher than 0.15%. In the embodiments (iv) set forth above the weight percentage of N usually is at least 0.01%, e.g., at least 0.015%, at least 0.02%, at least 0.03%, at least 0.04%, at least 0.05%, at least 0.06%, at least 0.08%, or at least 0.1%, but not higher than 1.2%, e.g., not higher than 1.1%, not higher than 1%, not higher than 0.9%, or not higher than 0.8%.

The weight percentage of B in the alloy of the present invention is at least 0.1%, e.g., at least 0.15%, at least 0.2%, at least 0.25%, at least 0.3%, at least 0.35%, at least 0.4%, at least 0.45%, at least 0.5%, at least 0.6%, at least 0.7%, at least 0.8%, at least 0.9%, or at least 1%, but not higher than 4%, e.g., not higher than 3.9%, not higher than 3.8%, not higher than 3.7%, not higher than 3.6%, not higher than 3.5%, not higher than 3.4%, not higher than 3.3%, not higher than 3.2%, not higher than 3.1%, not higher than 3%, not higher than 2.9%, not higher than 2.8%, not higher than 2.7%, not higher than 2.6%, not higher than 2.5%, not higher than 2.4%, not higher than 2.3%, not higher than 2.2%, not higher than 2.1%, not higher than 2%, not higher than 1.9% or not higher than 1.8%. In the embodiments (i) set forth above the weight percentage of B usually is at least 0.5%, e.g., at least 0.6%, at least 0.7%, or at least 0.8%, but not higher than 4%, e.g., not higher than 3.9%, not higher than 3.8%, not higher than 3.7%, not higher than 3.6%, not higher than 3.5%, not higher than 3.4%, not higher than 3.3%, not higher than 3.2%, not higher than 3.1%, not higher than 3%, not higher than 2.9%, not higher than 2.8%, not higher than 2.7%, not higher than 2.6%, not higher than 2.5%, not higher than 2.4%, not higher than 2.3%, not higher than 2.2%, not higher than 2.1%, not higher than 2%, not higher than 1.9% or not higher than 1.8%. In the embodiments (ii), (iii) and (iv) set forth above the weight percentage of B usually is at least 0.6%, e.g., at least 0.65%, at least 0.7%, at least 0.75%, at least 0.8%, at least 0.85%, or at least 0.9%, but not higher than 3.5%, e.g., not higher than 3.4%, not higher than 3.3%, not higher than 3.2%, not higher than 3.1%, not higher than 3%, not higher than 2.9%, not higher than 2.8%, not higher than 2.7%, not higher than 2.6%, not higher than 2.5%, not higher than 2.4%, not higher than 2.3%, not higher than 2.2%, not higher than 2.1%, not higher than 2%, not higher than 1.9%, not higher than 1.85%, not higher than 1.8%, or not higher than 1.75%.

The weight percentage of Ni in the alloy of the present invention is at least 0.1%, e.g., at least 0.15%, at least 0.25%, at least 0.5%, at least 1%, at least 1.5%, at least 1.7%, at least 1.8%, at least 1.9%, at least 2%, at least 2.2%, at least 2.4%, at least 2.6%, or at least 2.8%, but not higher than 7.5%, e.g., not higher than 7%, not higher than 6.8%, not higher than 6.6%, not higher than 6.4%, or not higher than 6.2%. In the embodiments (i) set forth above the weight percentage of Ni usually is at least 4%, e.g., at least 4.2%, at least 4.5%, or at least 4.8%, but not higher than 7.5%, e.g., not higher than 7%, not higher than 6.8%, not higher than 6.6%, not higher than 6.4%, or not higher than 6.2%. In the embodiments (ii) set forth above the weight percentage of Ni usually is at least 0.1%, e.g., at least 0.15%, at least 0.25%, at least 0.5%, at least 1%, at least 1.5%, at least 1.7%, at least 1.8%, at least 1.9%, at least 2%, at least 2.2%, at least 2.4%, at least 2.6%, or at least 2.8%, but not higher than 4%, e.g., not higher than 3.8%, not higher than 3.5%, not higher than 3.3%, or not higher than 3%. In the embodiments (iii) set forth above the weight percentage of Ni usually is at least 0.1%, e.g., at least 0.15%, at least 0.25%, at least 0.5%, at least 1%, at least 1.5%, at least 1.7%, at least 1.8%, at least 1.9%, at least 2%, at least 2.2%, at least 2.4%, at least 2.6%, or at least 2.8%, but not higher than 3.5%, e.g., not higher than 3.3%, not higher than 3.2%, not higher than 3.1%, or not higher than 3%. In the embodiments (iv) set forth above the weight percentage of Ni usually is at least 0.1%, e.g., at least 0.15%, at least 0.25%, at least 0.5%, at least 1%, at least 1.5%, at least 1.7%, at least 1.8%, at least 1.9%, at least 2%, at least 2.2%, at least 2.4%, at least 2.6%, or at least 2.8%, but not higher than 3.5%, e.g., not higher than 3.3%, not higher than 3.2%, not higher than 3.1%, or not higher than 3%.

The weight percentage of Si in the alloy of the present invention is at least 0.1%, e.g., at least 0.15%, at least 0.25%, at least 0.5%, at least 1%, at least 1.5%, at least 1.7%, at least 1.8%, at least 1.9%, at least 2%, at least 2.1%, or at least 2.3%, but not higher than 4%, e.g., not higher than 3.8%, not higher than 3.6%, not higher than 3.4%, not higher than 3.2%, or not higher than 3%. In the embodiments (i) set forth above the weight percentage of Si usually is at least 1.6%, e.g., at least 1.65%, at least 1.7%, or at least 1.8%, but not higher than 2.8%, e.g., not higher than 2.7%, not higher than 2.6%, not higher than 2.5%, not higher than 2.4%, or not higher than 2.3%. In the embodiments (ii) set forth above the weight percentage of Si usually is at least 1.6%, e.g., at least 1.65%, at least 1.7%, or at least 1.8%, but not higher than 2.8%, e.g., not higher than 2.7%, not higher than 2.6%, not higher than 2.5%, not higher than 2.4%, or not higher than 2.3%. In the embodiments (iii) set forth above the weight percentage of Si usually is at least 1.6%, e.g., at least 1.65%, at least 1.7%, or at least 1.8%, but not higher than 2.8%, e.g., not higher than 2.7%, not higher than 2.6%, not higher than 2.5%, not higher than 2.4%, or not higher than 2.3%. In the embodiments (iv) set forth above the weight percentage of Si usually is at least 1.6%, e.g., at least 1.65%, at least 1.7%, or at least 1.8%, but not higher than 3.5%, e.g., not higher than 3.3%, not higher than 3.2%, not higher than 3.1%, or not higher than 3%.

The alloy of the present invention usually comprises one or more additional elements, i.e., in addition to Fe, Cr, C, B, N, Ni and Si. For example, often the alloy will also comprise at least one or more (and frequently all or all but one) of V, Mn, Mo, Nb, Ti and Al. However, other elements such as one or more of W, Co, Cu, Mg, Ca, Ta, Zr, Hf, rare earth elements may (and often will) be present as well.

The alloy of the present invention usually comprises at least V as additional element. If employed, the weight percentage of V usually is at least 2%, e.g., at least 3%, at least 3.5%, at least 3.8%, at least 4%, at least 4.2%, or at least 4.5%, but usually not more than 12%, e.g., not more than 10%, not more than 8%, not more than 7.5%, or not more than 7%. Additionally, it is preferred for V to be present in weight percentages from 1.1 to 1.5 times (in particular from 1.1 to 1.4 times, or from 1.1 to 1.3 times) the combined weight percentage of C and N. As a general rule, the preferred concentration of V decreases with increasing concentration of Cr (while the preferred concentration of N increases with increasing concentration of Cr). In the case of embodiment (i) set forth above, V is usually present in weight percentages of not higher than 4%, e.g., not higher than 3.7%, not higher than 3.5%, or not higher than 3%, whereas in the case of embodiments (ii) to (iv) set forth above, V is usually present in weight percentages of not higher than 5%, e.g., not higher than 4.5%, not higher than 4.2%, or not higher than 4%.

If employed, Mn is usually present in the alloy of the present invention in a weight percentage of at least 0.1%, e.g., at least 0.3%, at least 0.5%, at least 0.8%, at least 1%, or at least 1.1%, but usually not higher than 8%, e.g., not higher than 7%, not higher than 6%, not higher than 5%, not higher than 4%, or not higher than 3%. In the embodiments (i) set forth above the weight percentage of Mn usually is at least 0.1%, e.g., at least 0.3%, at least 0.5%, at least 0.7%, or at least 0.8%, but not higher than 3%, e.g., not higher than 2.9%, not higher than 2.8%, not higher than 2.7%, not higher than 2.6%, or not higher than 2.5%. In the embodiments (ii) set forth above the weight percentage of Mn usually is at least 0.1%, e.g., at least 0.3%, at least 0.5%, at least 0.7%, or at least 0.8%, but not higher than 5%, e.g., not higher than 4.8%, not higher than 4.5%, not higher than 4.2%, or not higher than 4%. In the embodiments (iii) set forth above the weight percentage of Mn usually is at least 0.1%, e.g., at least 0.3%, at least 0.5%, at least 0.7%, or at least 0.8%, but not higher than 6%, e.g., not higher than 5.8%, not higher than 5.5%, not higher than 5.2%, or not higher than 5%. In the embodiments (iv) set forth above the weight percentage of Mn usually is at least 0.1%, e.g., at least 0.3%, at least 0.5%, at least 0.7%, or at least 0.8%, but not higher than 8%, e.g., not higher than 7.5%, not higher than 7%, not higher than 6.8%, or not higher than 6.5%.

If employed, Co is usually present in the alloy of the present invention in a weight percentage of at least 0.1%, e.g., at least 0.15%, at least 0.2%, at least 0.25%, or at least 0.3%, but usually not higher than 4%, e.g., not higher than 3%, not higher than 2%, not higher than 1.5%, not higher than 1%, or not higher than 0.5%.

If employed, Cu is usually present in the alloy of the present invention in a weight percentage of at least 0.1%, e.g., at least 0.2%, at least 0.3%, at least 0.4%, at least 0.45%, or at least 0.5%, but usually not higher than 4.5%, e.g., not higher than 4%, not higher than 3%, not higher than 2%, not higher than 1.5%, or not higher than 1.2%.

If employed, Mo and/or W are usually present in the alloy of the present invention in a combined weight percentage of at least 0.3%, e.g., at least 0.5%, at least 0.6%, or at least 0.7%, but usually not higher than 6%, e.g., not higher than 5%, not higher than 4%, not higher than 3.5%, or not higher than 3%. If only one of Mo and W is to be present, preference is usually given to Mo, which in this case is usually present in weight percentages not higher than 5%, e.g., not higher than 4%, not higher than 3.5%, or not higher than 3. Further, in the case of embodiments (i) set forth above, Mo is usually present in percentages by weight of not higher than 1%, e.g., not higher than 0.8%, not higher than 0.6%, or not higher than 0.5%. In the case of embodiments (ii) to (iv) set forth above, Mo is usually present in percentages by weight of not higher than 3%, e.g., not higher than 2.7%, not higher than 2.3%, or not higher than 2%.

If employed, Nb is usually present in the alloy of the present invention in a weight percentage of at least 0.01%, e.g., at least 0.05%, at least 0.1%, at least 0.2%, at least 0.3%, at least 0.4%, or at least 0.5%, but usually not higher than 6%, e.g., not higher than 4%, not higher than 3%, not higher than 2%, or not higher than 1%. In embodiments (i) to (iv) set forth above, Nb will usually be present in weight percentages of not more than 2%, e.g., not more than 1.5%, or not more than 1%.

If employed, Ti will usually be present in the alloy of the present invention in a weight percentage of at least 0.01%, e.g., at least 0.05%, at least 0.1%, at least 0.2%, at least 0.3%, at least 0.4%, or at least 0.5%, but usually not higher than 5%, e.g., not higher than 4%, not higher than 3%, not higher than 2%, or not higher than 1%. In embodiments (i) to (iv) set forth above, Ti will usually be present in weight percentages of not more than 3%, e.g., not more than 2.5%, not more than 2%, or not more than 1%.

If employed, Zr will usually be present in the alloy of the present invention in a weight percentage of at least 0.01%, e.g., at least 0.02%, at least 0.03%, at least 0.04%, at least 0.05%, or at least 0.1%, but usually not higher than 2%, e.g., not higher than 1.8%, not higher than 1.6%, not higher than 1.3%, or not higher than 1%.

If employed, Al will usually be present in the alloy of the present invention in a weight percentage of at least 0.01%, e.g., at least 0.02%, at least 0.03%, at least 0.04%, at least 0.05%, at least 0.1%, at least 0.2%, at least 0.3%, or at least 0.4%, but usually not higher than 2%, e.g., not higher than 1.5%, not higher than 1%, not higher than 0.9%, or not higher than 0.8%. In embodiment (i) set forth above Al will usually be present in weight percentages of not more than 2%, e.g., not higher than 1.7%, not higher than 1.5%, or not higher than 1.3%. In embodiments (ii) to (iv) set forth above Al will usually be present in weight percentages of not higher than 1.5%, e.g., not higher than 1.3%, not higher than 1%, or not higher than 0.9%. If Al is present, B is preferably present in a weight percentage that is at least 1.8 times, e.g., at least 1.9 times, or at least 2 times, but not higher than 2.5 times, e.g. not higher than 2.4 times, or not higher than 2.3 times the weight percentage of Al in order to obtain a satisfactory hardness of the alloy in the as cast state.

If employed at all, Mg and/or Ca are usually present in the alloy of the present invention in a combined weight percentage of at least 0.01%, e.g., at least 0.02%, at least 0.03%, or at least 0.04%, but usually not higher than 0.2%, e.g., not higher than 0.18%, not higher than 0.15%, or not higher than 0.12%. Each of Mg and Ca may be present in an individual weight percentage of at least 0.02% and not higher than 0.08%.

If employed, one or more rare earth elements are usually present in the alloy of the present invention in a combined weight percentage of at least 0.05%, e.g., at least 0.08%, at least 0.1%, or at least 0.15%, but usually not higher than 2%, e.g., not higher than 1%, not higher than 0.9%, or not higher than 0.8%.

If employed, Ta, Zr, Hf, and Al are usually present in the alloy of the present invention in a combined weight percentage of at least 0.01%, e.g., at least 0.05%, at least 0.08%, or at least 0.1%, but usually not higher than 3%, e.g., not higher than 2.5%, not higher than 2%, or not higher than 1.5%.

Among the unavoidable impurities which are usually present in the alloy of the present invention, sulfur and phosphorus may be mentioned. Their concentrations are preferably not higher than 0.2%, e.g., not higher than 0.1%, or not higher than 0.06% by weight each.

The alloy of the present invention is particularly suitable for the production of parts which are to have a high wear (abrasion) resistance and are suitably produced by a process such as sand casting. Non-limiting examples of such parts include slurry pump components, such as casings, impellers, suction liners, pipes, nozzles, agitators, valve blades. Other components which may suitably be made, at least in part, from the alloy of the present invention include, for example, shell liners and lifter bars in ball mills and autogenous grinding mills, and components of coal pulverizers.

Any conventional casting technology may be used to produce the alloy of the present invention. For example, the alloy may be cast into sand molds (referred to herein as "as cast state"). Alternatively, the alloy may be subjected to chill casting, for example, by pouring the alloy into a copper mold. This often affords a hardness which is significantly higher (e.g., by at least 20, and in some cases at least 50 Brinell units) than the hardness obtained by casting into a sand mold. Additionally, the cast alloy may be heat-treated at a temperature in the range of, for example, from 1800 to 2000° F., followed by air cooling, although this is usually not preferred or necessary, respectively. If a hardening treatment is to be carried out, the preferred hardening method for the alloy of the present invention is by cryogenic treatment: cooling to a temperature of, for example, −100 to −300° F., and maintaining at this temperature for a time of, for example one hour per one inch of casting wall thickness. The cryogenic tempering process may be performed with equipment and machinery that is conventional in the thermal cycling treatment field. First, the articles-under-treatment are placed in a treatment chamber which is connected to a supply of cryogenic fluid, such as liquid nitrogen or a similar low temperature fluid. Exposure of the chamber to the influence of the cryogenic fluid lowers the temperature until the desired level is reached.

EXAMPLES

Examples 1 to 5

Five alloys having the chemical compositions set forth in Table 1 below (in % by weight, S<0.025, P<0.1, Fe:Bal.) were melted in a 30 kg high frequency induction furnace. The initial charge materials were steel scrap, ferroalloy and pig iron. The melt temperature was controlled at 2700° F. to 2790° F. After all the charge materials had melted in the furnace, the liquidus temperature of the alloy was determined to be: Alloy 1—2197.4° F. Alloy 2—2185.7° F., Alloy 3—2165° F., Alloy 4—2167.4° F., Alloy 5—2199.9° F. Then the molten alloys were poured at a temperature of 2400° F.±10° F. into sand molds with dimensions of 20 mm×20 mm×110 mm to obtain four samples for testing for each alloy. In addition for chill casting each alloy was poured into a copper mold (30 mm diameter×35 mm height). The castings were cooled to ambient temperature both in the sand molds and the chill molds.

TABLE 1

| Alloy No. | C | Si | Mn | Cr | Ni | Mo | V | Ti | Nb | N | B | Al |
|---|---|---|---|---|---|---|---|---|---|---|---|---|
| 1 (comparative) | 3.78 | 2.2 | 1.5 | 8.8 | 5.6 | 0.43 | 2.2 | 0.45 | 0.77 | 0.013 | 0.0 | 0.67 |
| 2 | 3.73 | 2.3 | 1.6 | 8.4 | 5.64 | 0.34 | 2.1 | 0.41 | 0.80 | 0.03 | 1.55 | 0.62 |
| 3 | 3.86 | 2.23 | 1.4 | 8.2 | 5.55 | 0.22 | 2.0 | 0.47 | 0.88 | 0.04 | 1.28 | 0.64 |
| 4 | 3.95 | 2.25 | 1.55 | 8.1 | 5.73 | 0.13 | 1.8 | 0.02 | 0.91 | 0.045 | 1.30 | 0.71 |
| 5 | 4.34 | 2.23 | 1.6 | 8.5 | 5.85 | 0.33 | 2.34 | 0.98 | 0.63 | 0.048 | 1.46 | 0.81 |

Test Results:

All four of the samples made with Alloy No. 1 exhibited cracks throughout their length of 110 mm. This is probably due to the following reaction which proceeds at room temperature: $Al_4C_3+12\ H_2O \rightarrow 4\ Al(OH)_3+3\ CH_4\uparrow$. The cracks are likely caused by the pressure of the evolved methane gas and the fact that the volume of the reaction product $Al(OH)_3$ is about 15 times higher than the volume of $Al_4C_3$. The chill sample developed surface cracks during the Brinell hardness testing and indentation. By contrast, all samples made with Alloy Nos. 2-5 were crack free.

The Brinell (HB) hardness values (10 mm tungsten ball and load of 3000 kgf) measured on the samples (cast in sand mold, cast in chill mold, and in each case also after cryogenic hardening) are set forth in Table 2 below. Table 2 also sets forth the Rockwell (HRC) and Vickers (HV) hardness values which were obtained by conversion from the HB values. The HB value of Alloy No. 5 after chill casting and cryogenic hardening was too high for conventional measurement and was obtained by using a micro indenter (1000 g/f).

TABLE 2

| Alloy No. | Sand cast | Sand cast plus cryogenic hardening | Chill cast | Chill cast plus cryogenic hardening | Comments |
|---|---|---|---|---|---|
| 1 | 555 HB, 54 HRC 580 HV | 650 HB 59 HRC 680 HV | 575 HB 55.7 HRC 610 HV | 713 HB 62.5 HRC 760 HV | Cracks |
| 2 | 744 HB 63 HRC 780 HV | 780 HB 64.5 HRC 810 HV | 780 HB 64.5 HRC 810 HV | 812 HB 67 HRC 900 HV | No cracks |
| 3 | 780 HB 64.5 HRC 810 HV | 812 HB 67 HRC 900 HV | 812 HB, 67 HRC 900 HV | 850 HB, 67.5 HRC 920 HV | No cracks |
| 4 | 812 HB 67 HRC 900 HV | 850 HB, 67.5 HRC 920 HV | 812 HB, 67 HRC 900 HV | 890 HB, 68 HRC 940 HV | No cracks |
| 5 | 850 HB, 67.5 HRC 920 HV | 890 HB 68 HRC 940 HV | 890 HB 68 HRC 940 HV | 945 HB N/A HRC 1068 HV | No cracks |

The CBNVF values for Alloy Nos. 1-5 were determined according to the equations provided above and are set forth in Table 3 below. For example, the value for Alloy No. 4 was determined as follows:

$$C_E = \%\ C + \%\ N + (f \times \%\ B) = 3.95 + 0.045 + (2.2 \times 1.3) = 3.995 + 2.86 = 6.855$$

$$CBNVF = C_E \times 12.33 + (\%\ Cr + \%\ M) \times 0.55 - 15.2 = 6.855 \times 12.33 + (8.1 + 0.13 + 1.8 + 0.02 + 0.91) \times 0.55 - 15.2 == 84.52 + (10.96 \times 0.55) - 15.2 = 84.52 + 6.03 - 15.2 = 75.35$$

TABLE 3

| | Alloy No. | | | | |
|---|---|---|---|---|---|
| | 1 | 2 | 3 | 4 | 5 |
| (CBNVF) ± 3 (%) | 38-7% graphite = 31 | 80 | 74 | 75 | 86 |
| Comments | Graphite ~7% | No graphite | No graphite | No graphite | No graphite |

Microstructure Evaluation

Figure 2:
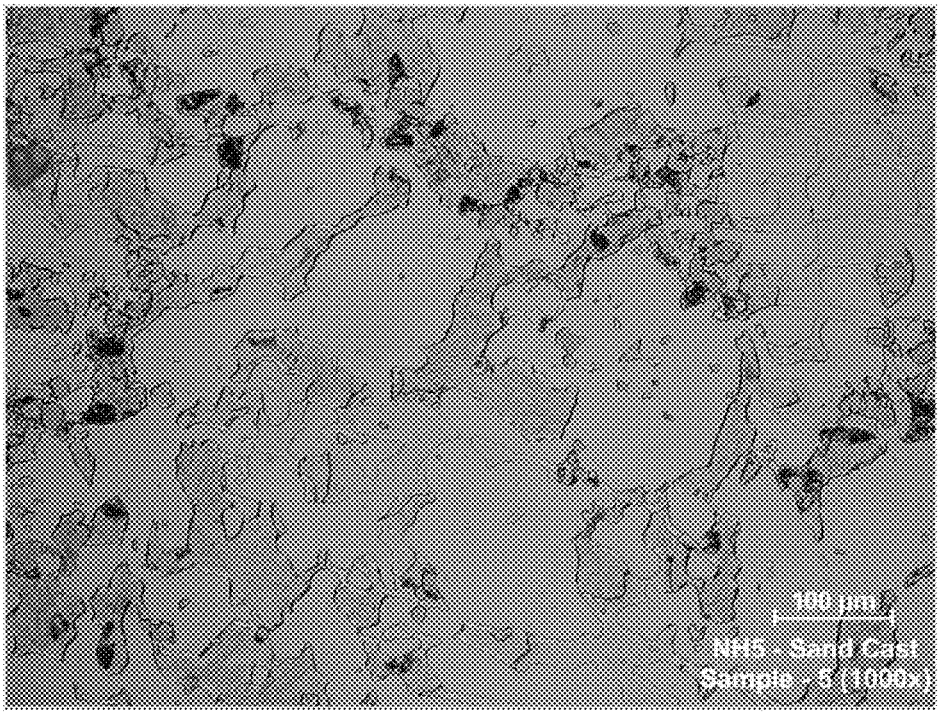
FIG. 2 shows the microstructure of a sand cast sample made from Alloy No. 5 set forth below.
Figure 3:
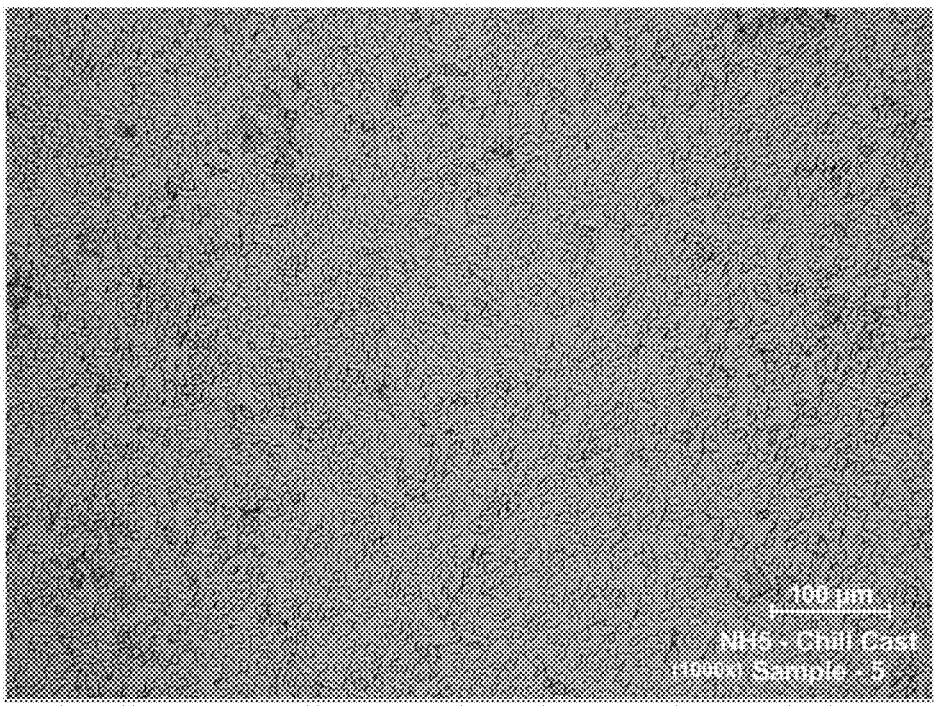
FIG. 3 shows the microstructure of a chill cast sample made from Alloy No. 5 set forth below.

FIG. 1 shows the microstructure of a sample made from comparative Alloy No. 1. The black flakes are graphite precipitate (volume fraction about 7%). FIG. 2 shows the microstructure of a sample made from Alloy No. 5 cast into a sand mold. The black spats are hard borides $AlB_2$, the light gray areas are primary and eutectic carbides, and the dark gray areas are the martensite matrix. FIG. 3 shows the microstructure of a sample made from Alloy No. 5 cast into a chill mold, with a refined carbide-boride-nitride microstructure.

Examples 6 to 15

Ten alloys having the chemical compositions set forth in Table 4 below ((in % by weight, S<0.025, P<0.1, Fe:Bal.) were melted in a 30 kg high frequency induction furnace. The initial charge materials were steel scrap, ferroalloy and pig iron. The melt temperature was controlled at 2700° F. to 2790° F. Then the molten alloys were poured at a temperature of 2550° F.±10° F. into sand molds with dimensions of 20 mm×20 mm×110 mm to obtain four samples for testing for each alloy. In addition for chill casting each alloy was poured into a copper mold (30 mm diameter×35 mm height). The castings were cooled to ambient temperature both in the sand molds and the chill molds.

TABLE 4

| Alloy No. | C | Si | Mn | Cr | Ni | Mo | V | Ti | Nb | N | B | Al |
|---|---|---|---|---|---|---|---|---|---|---|---|---|
| 6 (comp.) | 4.3 | 1.66 | 3.5 | 14.1 | 1.5 | 1.6 | 3.1 | 0.5 | 0 | 0.12 | 0 | 0.38 |
| 7 | 3.9 | 1.95 | 3.6 | 13.7 | 2.2 | 1.5 | 3.3 | 0.46 | 0 | 0.11 | 1.13 | 0.45 |
| 8 (comp.) | 4.1 | 2.1 | 3.9 | 17.5 | 2.1 | 1.6 | 3.8 | 0.18 | 0 | 0.10 | 0 | 0.03 |
| 9 | 3.7 | 2.4 | 3.1 | 17.2 | 2.03 | 1.48 | 3.7 | 0.4 | 0 | 0.08 | 1.34 | 0.44 |
| 10 (comp.) | 4.0 | 1.7 | 4.3 | 25.9 | 2.2 | 1.2 | 3.3 | 0.38 | 0 | 0.18 | 0 | 0 |
| 11 | 3.8 | 1.9 | 4.1 | 24.8 | 1.9 | 1.1 | 3.5 | 0.44 | 0 | 0.15 | 1.28 | 0.39 |
| 12 (comp.) | 4.3 | 2.2 | 4.7 | 31.3 | 1.8 | 0.7 | 4.4 | 0.55 | 1.2 | 0.34 | 0 | 0 |
| 13 | 4.0 | 2.3 | 5.2 | 32.1 | 2.2 | 0.55 | 4.5 | 0.66 | 0.9 | 0.28 | 1.23 | 0.36 |
| 14 (comp.) | 3.6 | 2.1 | 6.1 | 38.9 | 1.9 | 0.46 | 6.9 | 0.33 | 0.89 | 0.56 | 0 | 0 |
| 15 | 3.45 | 2.2 | 6.6 | 37.8 | 1.8 | 0.55 | 6.7 | 0.43 | 0.8 | 0.42 | 1.1 | 0.5 |

Test Results:

All four of the samples made from Alloy No. 6 had developed cracks throughout their length of 110 mm, presumably due to the reaction set forth above. The samples made from Alloy Nos. 7-15 were crack free.

The Brinell (HB) hardness values measured on the samples (cast in sand mold, cast in chill mold, and in each case also after cryogenic hardening) are set forth in Table 5 below. Table 5 also sets forth the Rockwell (HRC) and Vickers (HV) hardness values which were obtained by conversion from the HB values.

TABLE 5

| Alloy No. | Sand cast | Sand cast plus cryogenic hardening | Chill cast | Chill cast plus cryogenic hardening | Comments |
|---|---|---|---|---|---|
| 6 | 555 HB | 600 HB | N/A | N/A | Cracks |
| | 54 HRC | 57 HRC | | | |
| | 585 HV | 630 HV | | | |
| 7 | 713 HB | 780 HB | 880 HB | 940 HB | |
| | 62.5 HRC | 64.5 HRC | 68 HRC | N/A HRC | |
| | 760 HV | 810 HV | 940 HV | 1068 HV | |
| 8 | 555 HB | 600 HB | 650 HB | 680 HB | |
| | 54 HRC | 57 HRC | 59 HRC | 60 HRC | |
| | 585 HV | 630 HV | 680 HV | 711 HV | |
| 9 | 812 HB | 880 HB | 890 HB | 940 HB | |
| | 67 HRC | 68 HRC | 68 HRC | N/A HRC | |
| | 900 HV | 940 HV | 940 HV | 1068 HV | |
| 10 | 600 HB | 650 HB | 650 HB | 680 HB | |
| | 57 HRC | 59 HRC | 59 HRC | 60 HRC | |
| | 630 HV | 680 HV | 680 HV | 711 HV | |
| 11 | 812 HB | 880 HB | 890 HB | 940 HB | |
| | 67 HRC | 68 HRC | 68 HRC | N/A HRC | |
| | 900 HV | 940 HV | 940 HV | 1068 HV | |
| 12 | 680 HB | 713 HB, | cracks | N/A | |
| | 60 HRC | 62.5 HRC | | | |
| | 711 HV | 760 HV | | | |
| 13 | 812 HB | 880 HB | 890 HB | 940 HB | |
| | 67 HRC | 68 HRC | 68 HRC | N/A HRC | |
| | 900 HV | 940 HV | 940 HV | 1068 HV | |
| 14 | 680 HB | 713 HB | cracks | N/A | |
| | 60 HRC | 62.5 HRC | | | |
| | 711 HV | 760 HV | | | |
| 15 | 880 HB | 940 HB | 940 HB | 1147 HV | |
| | 68 HRC | N/A HRC | N/A HRC | | |
| | 940 HV | 1068 HV | 1068 HV | | |

The CBNVF values for Alloy Nos. 6-15 were determined according to the equations provided above and are set forth in Table 6 below.

TABLE 6

| Alloy No. | 6 | 7 | 8 | 9 | 10 | 11 | 12 | 13 | 14 | 15 |
|---|---|---|---|---|---|---|---|---|---|---|
| (CBNVF) ±3 (%) | 48 | 75 | 49 | 80 | 53 | 84 | 62 | 92 | 62 | 88 |
| Comments | $Al_4C_3$ | | | | | | | | | |

Examples 16 to 19

Large castings for a 3400 lbs. suction liner were made from the four alloys whose composition (in % by weight, S<0.025, P<0.1, Fe:Bal.) is set forth in Table 7 below.

TABLE 7

| Alloy No. | C | Si | Mn | Cr | Ni | Mo | V | Ti | Nb | N | B | Al |
|---|---|---|---|---|---|---|---|---|---|---|---|---|
| 16 | 4.55 | 2.29 | 0.9 | 9.23 | 6.7 | 0.28 | 3.05 | 0.65 | 0.00 | 0.04 | 0.48 | 0.14 |
| 17 | 3.11 | 2.37 | 0.93 | 8.48 | 6.36 | 0.27 | 2.73 | 0.62 | 0.02 | 0.036 | 1.88 | 0.3 |
| 18 | 4.41 | 2.3 | 4.7 | 33.2 | 0.16 | 0.96 | 5.19 | 0.04 | 0.00 | 0.31 | 0.22 | 0.02 |
| 19 | 3.93 | 1.8 | 6.2 | 29.5 | 1.8 | 0.55 | 7.1 | 0.2 | 0.00 | 0.24 | 0.55 | 0.06 |

The Brinell (HB) hardness values measured on the samples (cast in sand mold, cast in chill mold, and in each case also after cryogenic hardening) are set forth in Table 8 below.

TABLE 8

| Alloy No. | Sand cast | Sand cast plus cryogenic hardening | Chill cast | Chill cast plus cryogenic hardening | Comments |
|---|---|---|---|---|---|
| 16 | 744 HB | 782 HB | 782 HB | 852 RB | |
| 17 | 782 HB | 812 HB | 852 HB | 940 HB | |
| 18 | 744 HB | 760 HB | 782 HB | 812 HB | |
| 19 | 744 | 744 HB | 812 HB | 852 HB | |

The CBNVF values for Alloy Nos. 16-19 were determined according to the equations provided above and are set forth in Table 9 below.

TABLE 9

| | Alloy No. | | | |
|---|---|---|---|---|
| | 16 | 17 | 18 | 19 |
| (CBNVF) ± 3 (%) | 56 | 91 | 68 | 67 |

It is noted that the foregoing examples have been provided merely for the purpose of explanation and is in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A hypereutectic white iron alloy, wherein the alloy comprises, in weight percent based on a total weight of the alloy:

| | |
|---|---|
| C | from 3 to 6 |
| B | from 0.1 to 4 |
| N | from 0.01 to 1.2 |
| Cr | from 3 to 48 |
| Ni | from 0.1 to 7.5 |
| Si | from 0.1 to 4 |

-continued

| | |
|---|---|
| Mn | from 0 to 8 |
| Co | from 0 to 5 |

-continued

| | |
|---|---|
| Cu | from 0 to 5 |
| Mo | from 0 to 5 |
| W | from 0 to 6 |
| V | from 0 to 12 |
| Nb | from 0 to 6 |
| Ti | from 0 to 5 |
| Zr | from 0 to 2 |
| (Mg + Ca) | from 0 to 0.2 |
| one or more rare earth elements | from 0 to 3 |
| one or more of Ta, Hf, Al | from 0 to 3, |

remainder Fe and incidential impurities;

and wherein the alloy in an as cast state has a Brinell hardness (HB) of at least 700.

2. The alloy of claim 1, wherein the alloy has a carbide-boride-nitride volume fraction (CBNVF) of at least 50, calculated according to the following equation:

$$CBNVF=C_E\times 12.33+(\%\ Cr+\%\ M)\times 0.55-15.2$$

with M=total percentage of V, Mo, Nb, and Ti, and $C_E$=% C+% N+(f×% B), where f=1.2 for B concentrations from 0.1% to 0.49%

1.48 for B concentrations from 0.5% to 0.99%

2.2 for B concentrations from 1.0% to 1.8%

2.6 for B concentrations from 1.81% to 2.5%

2.7 for B concentrations from 2.51% to 3.0%

2.8 for B concentrations from 3.01% to 4%.

3. The alloy of claim 2, wherein the alloy has a CBNVF of at least 55.

4. The alloy of claim 2, wherein the alloy has a CBNVF of at least 60.

5. The alloy of claim 1, wherein the alloy comprises

| | |
|---|---|
| C | from 3 to 4.8 |
| B | from 0.5 to 4 |
| N | from 0.01 to 0.1 |
| Cr | from 3 to 11 |
| Ni | from 4 to 7.5 |
| Si | from 1.6 to 2.8 |
| Mn | from 0.1 to 3 |
| Mo | from 0 to 1 |
| W | from 0 to 2 |
| V | from 0 to 4 |
| Nb | from 0 to 2 |
| Ti | from 0 to 3 |
| Zr | from 0 to 2 |
| Al | from 0.1 to 2. |

6. The alloy of claim 1, wherein the alloy comprises

| | |
|---|---|
| C | from 3.5 to 4.5 |
| B | from 0.6 to 3.5 |
| N | from 0.01 to 0.2 |
| Cr | from 12 to 23 |
| Ni | from 0.1 to 4 |
| Si | from 1.6 to 2.8 |
| Mn | from 0.1 to 5 |
| Mo | from 0 to 3 |
| W | from 0 to 2 |
| V | from 0 to 5 |
| Nb | from 0 to 2 |
| Ti | from 0 to 3 |
| Zr | from 0 to 2 |
| Al | from 0.01 to 1.5. |

7. The alloy of claim 6, wherein the alloy comprises from 1.5% to 4% of Ni.

8. The alloy of claim 6, wherein the alloy has a carbide-boride-nitride volume fraction (CBNVF) of at least 60, calculated according to the following equation:

$$CBNVF=C_E\times 12.33+(\%\ Cr+\%\ M)\times 0.55-15.2$$

with M=total percentage of V, Mo, Nb, and Ti, and $C_E$=% C+% N+(f×% B), where f=1.48 for B concentrations from 0.5% to 0.99%

2.2 for B concentrations from 1.0% to 1.8%

2.6 for B concentrations from 1.81% to 2.5%

2.7 for B concentrations from 2.51% to 3.0%

2.8 for B concentrations from 3.01% to 4%.

9. The alloy of claim 1, wherein the alloy comprises

| | |
|---|---|
| C | from 3.5 to 4.5 |
| B | from 0.6 to 3.5 |
| N | from 0.01 to 0.3 |
| Cr | from 24 to 30 |
| Ni | from 0.1 to 3.5 |
| Si | from 1.6 to 2.8 |
| Mn | from 0.1 to 6 |
| Mo | from 0 to 3 |
| W | from 0 to 2 |
| V | from 0 to 5 |
| Nb | from 0 to 2 |
| Ti | from 0 to 3 |
| Zr | from 0 to 2 |
| Al | from 0.01 to 1.5. |

10. The alloy of claim 9, wherein the alloy comprises from 1.5% to 3.5% of Ni.

11. The alloy of claim 9, wherein the alloy comprises from 3% to 6% of Mn.

12. The alloy of claim 9, wherein the alloy has a carbide-boride-nitride volume fraction (CBNVF) of at least 65, calculated according to the following equation:

$$CBNVF=C_E\times 12.33+(\%\ Cr+\%\ M)\times 0.55-15.2$$

with M=total percentage of V, Mo, Nb, and Ti, and $C_E$=% C+% N+(f×% B), where f=1.48 for B concentrations from 0.5% to 0.99%

2.2 for B concentrations from 1.0% to 1.8%

2.6 for B concentrations from 1.81% to 2.5%

2.7 for B concentrations from 2.51% to 3.0%

2.8 for B concentrations from 3.01% to 4%.

13. The alloy of claim 1, wherein the alloy comprises

| | |
|---|---|
| C | from 3.5 to 6 |
| B | from 0.6 to 3.5 |
| N | from 0.01 to 1.2 |
| Cr | from 31 to 48 |
| Ni | from 0.1 to 3.5 |
| Si | from 1.6 to 3.5 |
| Mn | from 0.1 to 8 |
| Mo | from 0 to 3 |
| W | from 0 to 2 |
| V | from 0 to 5 |
| Nb | from 0 to 2 |
| Ti | from 0 to 3 |
| Zr | from 0 to 2 |
| Al | from 0.01 to 1.5. |

14. The alloy of claim 13, wherein the alloy has a carbide-boride-nitride volume fraction (CBNVF) of at least 65, calculated according to the following equation:

$$CBNVF=C_E\times 12.33+(\%\ Cr+\%\ M)\times 0.55-15.2$$

with M=total percentage of V, Mo, Nb, and Ti, and $C_E$=% C+% N+(f×% B), where f=1.48 for B concentrations from 0.5% to 0.99%

2.2 for B concentrations from 1.0% to 1.8%
2.6 for B concentrations from 1.81% to 2.5%
2.7 for B concentrations from 2.51% to 3.0%
2.8 for B concentrations from 3.01% to 4%.

15. The alloy of claim 1, wherein the alloy in an as cast state has a Brinell hardness (HB) of at least 720.

16. The alloy of claim 1, wherein the alloy in an as cast state has a Brinell hardness (HB) of at least 740.

17. The alloy of claim 1, wherein the alloy in an as cast state has a Brinell hardness (HB) of at least 760.

18. The alloy of claim 1, wherein the alloy in an as cast state has a Brinell hardness (HB) of at least 780.

19. A hypereutectic white iron alloy, wherein the alloy comprises, in weight percent based on a total weight of the alloy:

| | |
|---|---|
| C | from 3 to 4.8 |
| B | from 0.5 to 4 |

-continued

| | |
|---|---|
| N | from 0.01 to 0.1 |
| Cr | from 7 to 11 |
| Ni | from 4 to 7.5 |
| Si | from 1.6 to 2.8 |
| Mn | from 0.1 to 3 |
| Co | from 0 to 5 |
| Cu | from 0 to 5 |
| Mo | from 0 to 1 |
| W | from 0 to 2 |
| V | from 0 to 4 |
| Nb | from 0 to 2 |
| Ti | from 0 to 3 |
| Zr | from 0 to 2 |
| (Mg + Ca) | from 0 to 0.2 |
| Al | from 0.1 to 2 |
| one or more rare earth elements | from 0 to 3 |
| one or more of Ta, Hf, Al | from 0.1 to 3, |

remainder Fe and incidential impurities.

* * * * *